US012313390B2

(12) United States Patent
Kruger

(10) Patent No.: US 12,313,390 B2
(45) Date of Patent: May 27, 2025

(54) DEPLOYMENT OF A DETONATOR ASSEMBLY

(71) Applicant: DETNET SOUTH AFRICA (PTY) LTD, Johannesburg (ZA)

(72) Inventor: Michiel Jacobus Kruger, Johannesburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 0 days.

(21) Appl. No.: 18/694,180

(22) PCT Filed: Sep. 8, 2022

(86) PCT No.: PCT/ZA2022/050046
§ 371 (c)(1),
(2) Date: Mar. 21, 2024

(87) PCT Pub. No.: WO2023/049943
PCT Pub. Date: Mar. 30, 2023

(65) Prior Publication Data

US 2024/0393094 A1 Nov. 28, 2024

(30) Foreign Application Priority Data

Sep. 22, 2021 (ZA) ..... 2021/07056

(51) Int. Cl.
*F42D 1/05* (2006.01)
*F42B 3/22* (2006.01)
(Continued)

(52) U.S. Cl.
CPC ..... *F42D 1/05* (2013.01); *F42B 3/22* (2013.01); *F42D 1/04* (2013.01); *F42D 1/22* (2013.01); *F42C 11/04* (2013.01); *F42C 19/12* (2013.01)

(58) Field of Classification Search
CPC ... F42D 1/04; F42D 1/045; F42D 1/05; F42D 1/22; F42B 3/10; F42B 3/12; F42B 3/22; F42C 11/04; F42C 19/12
(Continued)

(56) References Cited

U.S. PATENT DOCUMENTS 3,033,114 A * 5/1962 Gieske ..... F42D 1/05 102/202.3
3,255,366 A * 6/1966 McNulty ..... H03K 3/537 361/251
(Continued)

FOREIGN PATENT DOCUMENTS

AU 2012272289 A1 2/2014

OTHER PUBLICATIONS

International Search Report and Written Opinion for Application No. PCT/ZA2022/050046 dated Dec. 13, 2022 (13 pages).
(Continued)

*Primary Examiner* — James S Bergin
(74) *Attorney, Agent, or Firm* — Michael Best & Friedrich LLP

(57) ABSTRACT

A detonator assembly which includes a holder, a flexible elongate element which is engaged with the holder, a detonator connected to the element, an energy storage device on the holder and a coil arrangement for charging the energy storage device when the coil arrangement is coupled to a variable electromagnetic field.

6 Claims, 3 Drawing Sheets

(51) Int. Cl.

| | |
|---|---|
| ***F42D 1/04*** | (2006.01) |
| ***F42D 1/22*** | (2006.01) |
| *F42C 11/04* | (2006.01) |
| *F42C 19/12* | (2006.01) |

(58) Field of Classification Search
USPC ..... 102/206, 207, 209
See application file for complete search history.

(56) References Cited

U.S. PATENT DOCUMENTS

| | | | | |
|---|---|---|---|---|
| 3,942,373 | A * | 3/1976 | Rogers | E21B 31/00 73/152.56 |
| 4,454,814 | A * | 6/1984 | Henry | E21B 43/11857 175/4.55 |
| 5,010,821 | A | 4/1991 | Blain | |
| 6,470,803 | B1 * | 10/2002 | Liu | F42D 1/05 102/206 |
| 11,421,972 | B2 * | 8/2022 | Knight | F42C 11/04 |
| 2019/0119066 | A1 | 4/2019 | Muller et al. | |
| 2024/0401922 | A1 * | 12/2024 | Nguyen | F42D 1/05 |

OTHER PUBLICATIONS

International Preliminary Report on Patentability for Application No. PCT/ZA2022!050046 dated Dec. 6, 2023 (5 pages).

* cited by examiner

DEPLOYMENT OF A DETONATOR ASSEMBLY

CROSS REFERENCE TO RELATED APPLICATIONS

This application is a U.S. National Phase application of International Patent Application No. PCT/ZA2022/050046 filed Sep. 8, 2022 which claims priority to South Africa Patent Application ZA 2021/07056 filed Sep. 22, 2021, the entire contents of both of which are herein incorporated by reference.

BACKGROUND OF THE INVENTION

This invention relates to the deployment of a detonator assembly.

One type of detonator assembly includes a spool onto which is coiled a flexible elongate conductor. A detonator is connected to the conductor. Mounted to the spool is an energy storage device, e.g. a battery or a capacitor which, in use, provides power for operating the detonator.

The incorporation of the energy storage device can be problematic, particularly during storage and transport phases of the detonator assembly. Care must be taken to ensure that no situation can arise in which the energy storage device could, inadvertently, cause ignition of the detonator.

An object of the present invention is to address, at least to some extent, the aforementioned situation.

SUMMARY OF THE INVENTION

The invention provides a method of deploying a detonator assembly which includes a holder, a flexible elongate element which is engaged with the holder, a detonator connected to the elongate element and an energy storage device on the holder, the method including the steps of charging the energy storage device at the time of installing the detonator in a borehole and, thereafter, of using energy from the energy storage device for communicating through the elongate element with the detonator.

In one form of the invention the energy storage device is not, initially, charged with energy.

In another form of the invention the energy storage device initially is charged with energy which is usable for communication purposes but which is inadequate for firing the detonator.

The elongate element may be engaged with the holder in any convenient way. In one respect the holder may fulfil the function of a top box generally in a manner which is known in the art.

Preferably, at least for convenience, the holder comprises a spool, although the holder can take on other forms.

In the spool embodiment, prior to deployment of the detonator assembly, the elongate element is preferably coiled on the spool. This is convenient for storage and transport purposes. The elongate element, which is flexible, is then uncoiled, when needed for deployment.

The detonator assembly may include, mounted to or associated with, the holder, a communication device which, in use, is powered by energy from the energy storage device for communicating with the detonator and, when required, for transmitting a fire signal to the detonator.

The energy storage device may be charged in any appropriate way for example through the use of inductive (electromagnetic) techniques.

In one example of the invention the holder includes a secondary coil which is inductively coupled to a primary coil so that energy is induced into the secondary coil. The primary coil may therefore be connected to an alternating electrical energy source.

In a different approach the holder, preferably in the form of a spool, includes a coil which is caused to move relative to a magnetic field. The magnetic field may be produced by a permanent magnet or an electromagnet. Movement of the coil through the magnetic field induces current into the coil and this is used to charge the energy storage device.

An advantage of the aforementioned process is that the energy storage device, which for example may be a battery or a supercapacitor, may initially be completely depleted and have no energy during modes in which the detonator assembly is stored or transported. This inherently raises the safety level of the detonator assembly. Energy is then transferred to the energy storage device to enable the detonator assembly to become operative only at the time of deployment.

The detonator may be placed into a borehole to a desired depth and, at that stage, the energy storage device may be charged. Alternatively, possibly depending on the construction of the holder, the energy storage device may be charged before placement of the detonator, or while the detonator is being placed, into the borehole.

Charging may be effected by coupling a secondary coil in the holder to a custom-designed inductive charger which includes a primary coil.

The holder may for example be mounted, e.g. rotatably, to a support. The primary coil of the inductive charger may be mounted to the support. When an alternating current is applied to the primary coil electrical energy is induced into the secondary coil.

An appropriate form of construction is for the support to include a spigot which extends into an aperture in the holder—this configuration helps to position the secondary coil correctly relative to the primary coil in the support.

In a different approach a suitably wound coil on the holder is caused to move relative to a magnetic field so that a voltage is induced into the coil. The magnetic field may be established by a permanent magnet or by means of an appropriate electrical arrangement. The energy output from that coil is then used to charge the energy storage device.

In one form of construction a permanent magnet is mounted to the support and the holder is rotatably engaged with the support so that upon rotation of the holder the coil is caused to move through the magnetic field which is produced by the magnet.

The invention also extends to a detonator assembly which includes a holder, a flexible elongate element which is engaged with the holder, a detonator connected to the element, an energy storage device on the holder and a coil arrangement for charging the energy storage device when the coil arrangement is coupled to a variable electromagnetic field.

The electromagnetic field may be established by means of an alternating current in a primary coil arrangement. Alternatively the secondary coil arrangement may be caused to move through a magnetic field which is established by means of a permanent magnet or by passing current through a primary coil arrangement.

The flexible elongate element may comprise a shock tube, a fiber optic cable or one or more electrically conductive cables or wires. If use is made of a shock tube, electrically conductive wires may be included in the shock tube for communication purposes with the detonator.

In one form of the invention the energy storage device, initially, may be charged with energy which is inadequate to fire the detonator but which is adequate for communication purposes.

In another form of the invention the energy storage device has no energy, or the energy in the device is inadequate for firing the detonator and even for communication purposes.

In a preferred embodiment the holder comprises a spool.

The detonator assembly may include a communication module which is mounted to the spool. The communication module may be configured to communicate with a blast controller, a relay station in a blasting system or another detonator assembly so that signals can be sent at least to the detonator which is connected to the flexible elongate element. Preferably bidirectional communication can be established between the spool and any of the devices referred to.

The communication module, drawing energy from the energy storage device, is then enabled to interact with the detonator with the nature of such interaction being dependent at least on the construction of the flexible elongate element. For example if the element is a shock tube then subject to a signal from the communication module the shock tube may be ignited to cause ignition of the detonator. If the elongate flexible element is conductive then communication signals may be sent to the detonator and returned from the detonator to the communication module and, as appropriate, energy may be transmitted via the flexible elongate element to the detonator and such energy can be used for firing the detonator as required.

The elongate element may initially be coiled on the holder, particularly for storage and transport purposes, and may be uncoiled when required for deployment purposes.

BRIEF DESCRIPTION OF THE DRAWINGS

The invention is further described by way of examples with reference to the accompanying drawings in which.

DESCRIPTION OF PREFERRED EMBODIMENTS

Figure 1:
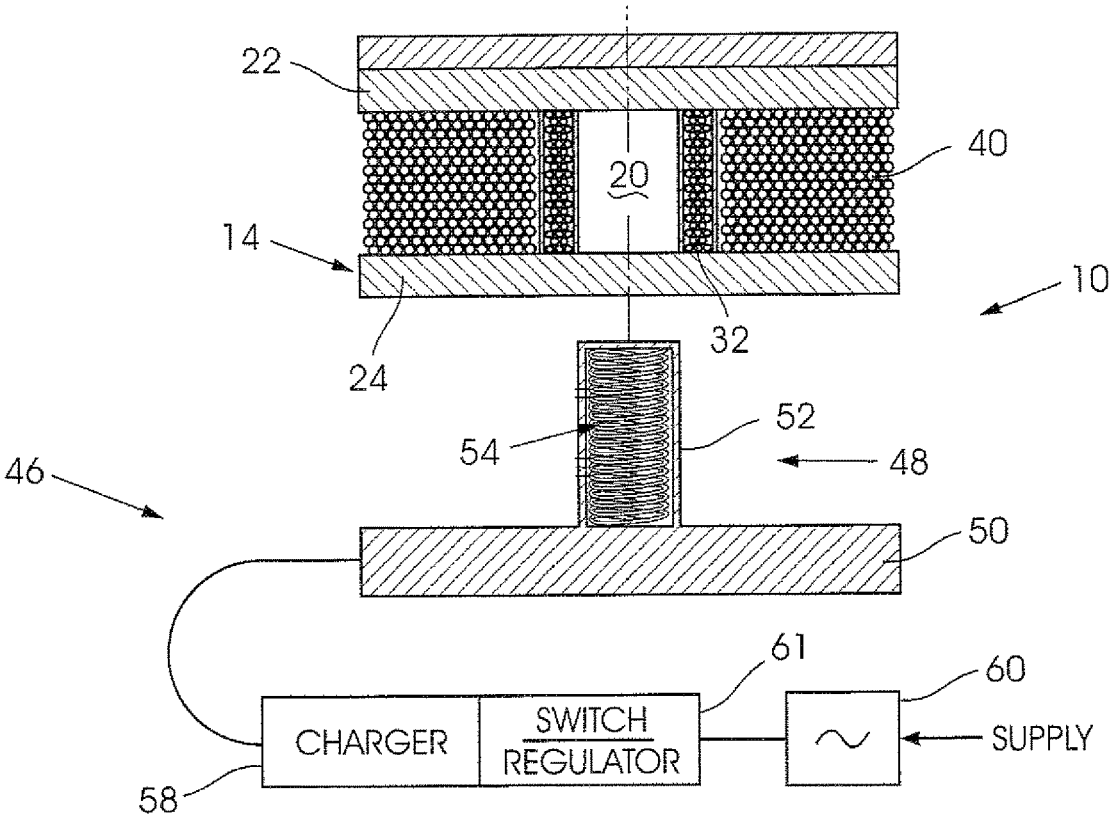
FIG. 1 is an exploded view of a detonator assembly according to one form of the invention.
Figure 2:
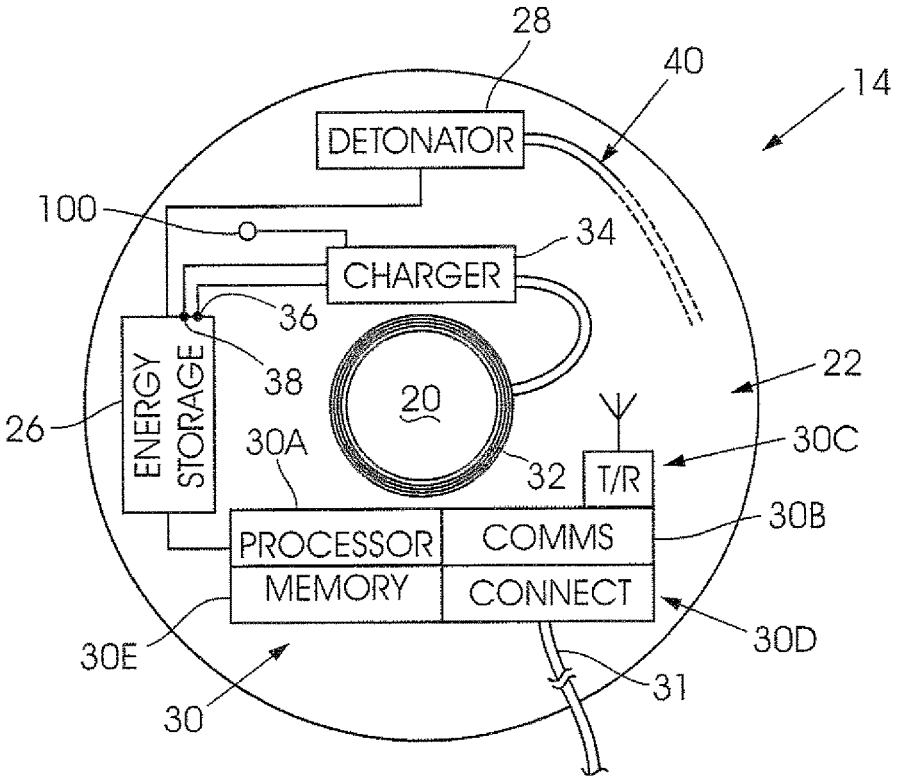
FIG. 2 is a plan view of a spool which is included in the detonator assembly.

FIG. 1 of the accompanying drawings is an exploded side view, partly sectioned, of a detonator assembly 10 according to the invention while FIG. 2 is a view in plan of a holder which in this embodiment is a spool 14 which is included in the detonator assembly 10.

The spool 14 comprises a tubular core 20 with opposing flanges 22 and 24 respectively. Fixed to the flange 22 are various components which are shown in detail in FIG. 2, namely an energy storage device 26, which is typically a battery or a capacitor, preferably in that respect a supercapacitor, a detonator 28, and a control device 30 which comprises a processor 30A and a communication module 30B. These components are used to control the firing of the detonator 28. The various components are mounted to the outer surface of the flange in a secure manner. In particular the detonator is held in position by means of a releasable clip arrangement, not shown.

The communication module 30B is also used, as needed, to communicate with a blast controller, a repeater or relay station, or one or more similar modules 30B associated with other detonator assemblies (not shown).

A secondary inductive coil 32 is located in the core 20. The coil 32 is connected to a charge conditioning circuit 34 which comprises a rectifier and a voltage regulator, and leads from the circuit terminate in contacts 36 and 38 to which the energy storage device 26 is connected.

An elongate flexible conductor 40 is coiled around the tubular core 20. The nature of the conductor 40 depends on the type of detonating arrangement in which the assembly 10 is used. The conductor may for example be a shock tube which is used to fire the detonator 28, when needed. If use is made of a shock tube then, if required, a communication link between the module 30B and the detonator can be established by means of conductors provided for the purpose e.g. embedded in the shock tube. Alternatively the conductor 40 is an optical cable or it includes electrically conductive wires used to transfer arm and fire signals to the detonator. The conductor 40 is connected to the detonator 28 and to the energy storage device 26. The firing of the detonator is effected, when required, by means of a fire signal sent to the detonator 28 from the control device 30 in response to a radio signal which is transmitted by a blast controller or similar device (not shown) to the control device 30, or in response to a signal which is transmitted via a conductor to the control device 30. In the former case, for wireless communication, the module 30B includes a transmitter, a receiver and a suitable antenna (30C). In the latter case a connector 30D is provided for connection to a conductor 31 which forms a part of a blast harness (not shown) at the blast site.

The detonator assembly 10 is supplied, ex-factory, with the energy storage device 26. In one form of the invention the device 26 is depleted i.e. no energy is stored in the device 26. The detonator assembly 10 is inert and, as there is no power source, it is not possible for the detonator 28 to be ignited. In another form of the invention there is energy in the device 26 but the energy level is inadequate for firing the detonator 28 or even for communication purposes. Another possibility is to charge the device 26 beforehand with energy which is adequate for communication but which is inadequate for firing the detonator.

A further variation is to include in the device 26 a battery with sufficient energy for communication purposes and then to use the charging arrangement 46 as is described hereinafter for charging another battery, or a capacitor, in the device 26 with sufficient energy for firing the detonator 28.

The detonator assembly 10 includes a charging arrangement 46 (FIG. 1) which is associated with a pedestal 48 which has a base 50 and a spigot 52 which is configured to be inserted into the tubular core 20, when necessary. A primary induction coil 54 is located in or on the spigot. The primary coil 54 is connected to a charging apparatus 58 which draws power from a source 60 which preferably is mobile. Electrical connection of the primary induction coil 54 to the source 60 is controlled by means of a switching and regulating circuit 61, which may be manually actuable by a technician, and which is included in the charging apparatus 58.

At a blast site the charging arrangement 46 is mounted to or otherwise is carried by a vehicle (not shown) which could also be used for conveying a plurality of detonator assemblies 10 to various blastholes at the site (not shown). Each detonator assembly 10 is associated with a respective blasthole. Each assembly 10 preferably has a unique identifier stored in a memory 30E which is linked to the processor 30A. Similarly each blasthole is uniquely identified in a blast plan held, for example, at the blast controller (not shown). Thus the position of each detonator assembly is unambiguously linked to the location of the blasthole at which the detonator assembly is to be deployed.

At each blasthole a respective detonator 28 is lowered into the blasthole to a required depth. In the process, a length of the flexible elongate conductor 40 is payed out from the spool 14. The conductor could have length markings to facilitate this process. Subsequently the spool 14 is placed onto the pedestal 48 with the spigot 52 located inside the tubular core 20. Once the charging apparatus 58 is actuated, the source 60 is connected to the primary inductive coil 54. The source 60 is configured to operate at a suitable voltage current and frequency, thereby to act as an excitation source for the coil 54.

The coil 54 is closely electromagnetically coupled to the secondary coil 32 and energy which is induced into the secondary coil 32 is conditioned via the charging circuit 34. An output signal from the circuit 34 is used to charge the device 26.

The energy storage device 26 may comprise a battery or a capacitor, in this instance preferably a super-capacitor, and, as appropriate, other techniques can be used to charge the energy storage device. The device may, initially, include a first battery, or a partially charged battery, with sufficient energy for communication purposes, but the energy level is inadequate for firing the detonator.

In each embodiment once the charging process has been completed the detonator assembly 10 has an onboard power supply and, subject to control signals from a blast controller, is in a ready-to-use condition.

The deployment and charging process is repeated, as required, for each detonator assembly at each respective blasthole.

Once all the detonator assemblies have been installed in the respective blastholes and have been provided with respective onboard energy sources, as described, conventional blasting protocols and procedures are carried out for testing, control and delay assignment purposes, prior to firing taking place.

Figure 3:
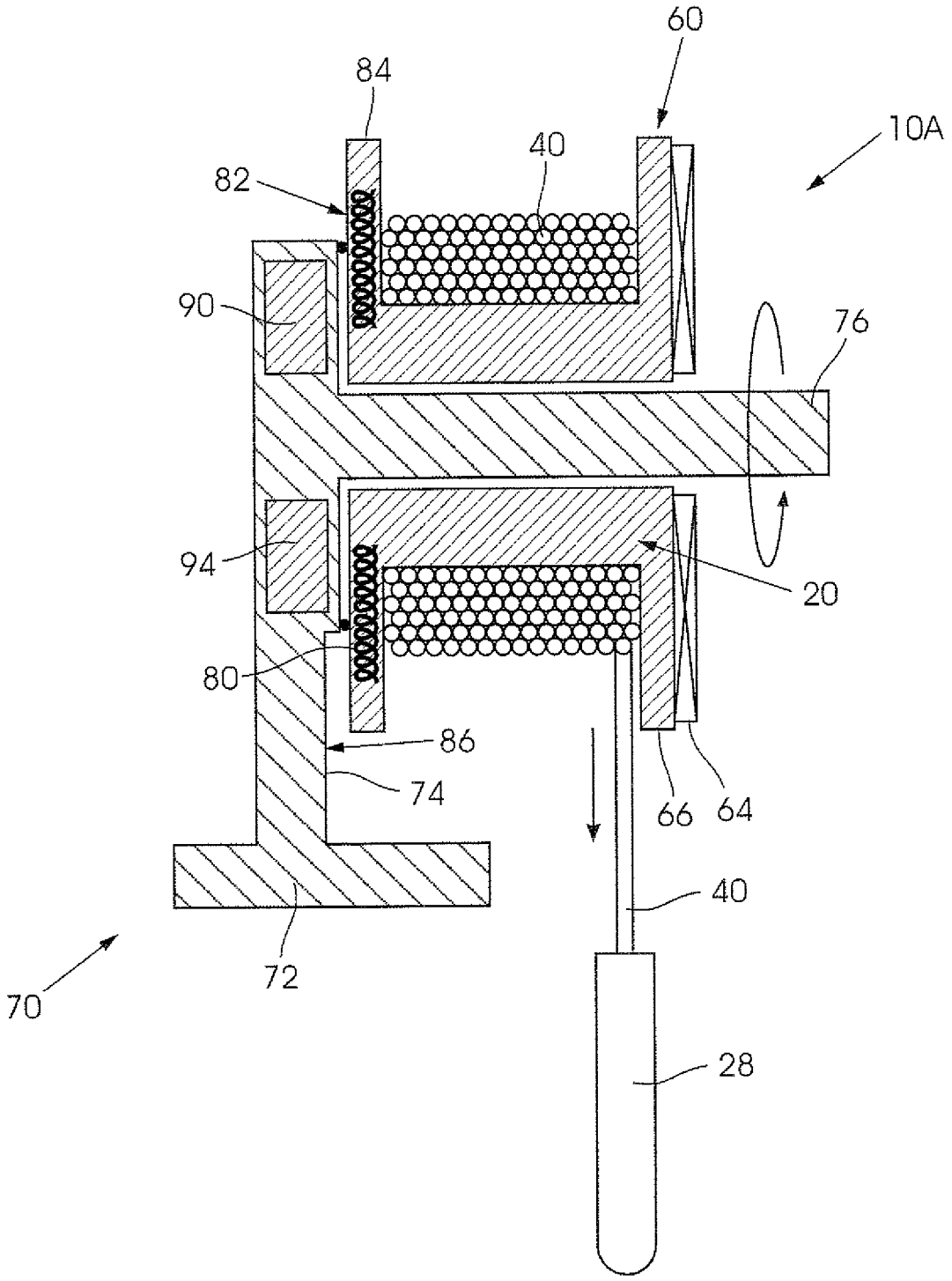
FIG. 3 is a side view in section of a detonator assembly according to a different form of the invention.
Figure 4:
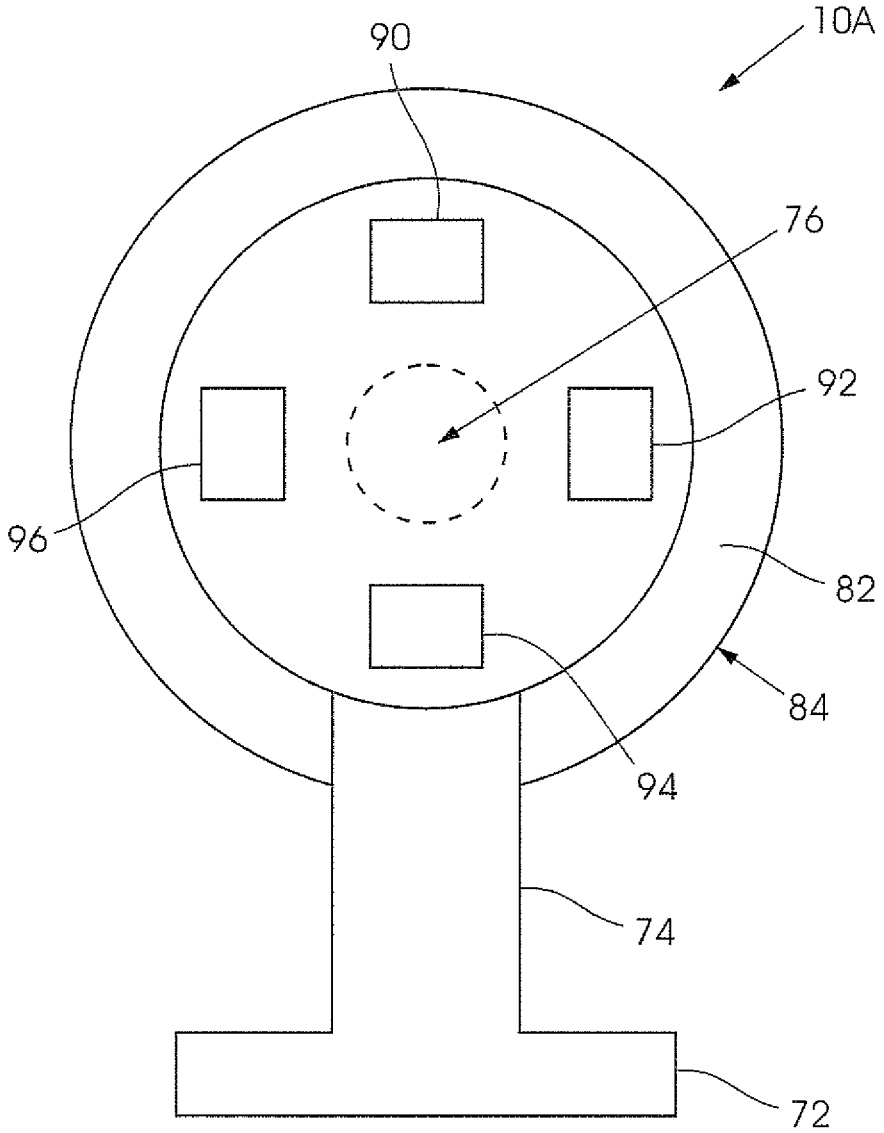
FIG. 4 is an end view of the arrangement shown in FIG. 3.

FIGS. 3 and 4 are respectively a side view in cross section and an end view of a detonator assembly 10A according to a different form of the invention. The detonator assembly 10A includes a spool 60 which is similar to the spool 14 and which for this reason is not described in detail. Where applicable like reference numerals are used to indicate like elements. The various components (26 to 36) shown in FIG. 2 are collectively housed in an enclosure 64 on a first flange 66 of the spool.

The detonator assembly 10A includes a pedestal support 70 comprising a base 72 and an upright 74 from which extends an axle 76 which, in an operative arrangement, is inside the tubular core 20 of the spool. Use is made of low friction materials to ensure that the spool can rotate freely and easily on the axle. Any appropriate mechanism e.g. a clip, can be used to ensure that the spool can rotate freely on the axle 70 but is retained on the axle.

An elongate flexible conductor 40, of the kind described hereinbefore, is wound on the tubular core 20.

Inside the material of the spool 60 a secondary coil 80 is located. This is adjacent an outer face 82 of a second flange 84 of the spool. The face 82 is close to a surface 86 of the upright 74. Positioned inside the upright are four circumferentially spaced apart permanent magnets 90, 92, 94 and 96 respectively.

FIG. 3 shows the detonator 28 detached from the enclosure 64 and connected to and suspended from a free end of the conductor 40. This allows the detonator to be lowered into a borehole, not shown, to a required depth.

Prior thereto, with the detonator 28 still in position in the enclosure 64 and with the free end of the conductor 40 fixed in position on the spool 60, so that the end is not loose, the spool is rotated on the axle 76. The movement of the coil 80 though the magnetic fields produced by the permanent magnets 90 to 96 induces an electrical source into the coil. Current drawn from that source, under the control of the charging circuit 34 in the enclosure 64, is used to charge the energy storage device 26. When the device is fully charged the detonator 28 is lowered into the borehole. The support 70 is then available for use at a succeeding borehole.

Rotation of the spool can be done manually although, if there are a large number of detonator assemblies, this approach could be laborious. Preferably therefore rotation of the spool is done by means of an electric motor, not shown, which is mounted to the pedestal support 70. For example, a periphery of the second flange 84 may be in the form of a gear with teeth which engage with a toothed pinion on a drive shaft of the motor. Another possibility is to have a rubber drive pinion on the motor drive shaft and to engage the rubber pinion with a peripheral outer surface of the second flange 84 so that rotational drive is frictionally transferred, as required, to the spool. It is also possible to have the spool fixed in position and to move permanent magnets which are mounted to suitable structure, e.g. by means of a manually operated actuator or by means of an electric motor thereby to create a moving magnetic field which intersects the windings of the coil 80.

Another approach is to lower the detonator 28 suspended from the conductor 40, into a borehole with the detonator then descending under gravity action. The speed of rotation of the spool may be restricted by applying a braking force to a perimeter of the spool by manually pushing an object into frictional engagement with the spool, or, more simply, by gripping the spool so that it rotates at a slower speed—this action may be required to prevent wires in the borehole from becoming entangled. As the spool rotates electrical energy which is generated is stored in the storage device 26.

An advantage of the invention lies in the fact that the energy storage device, be it a battery or capacitor, during storage and transport phases of the spool, has no electrical charge. To that extent the detonator assembly is inherently safe for without an energy source the detonator 28 cannot be ignited. When the detonator assembly is to be deployed, the spool is inductively coupled to the charging arrangement. This is convenient for no direct electrical connections to terminals or contacts are required. When the energy storage device 26 is fully charged, this is sensed by the regulating circuit 61 and the charging process stops. Overcharging of the energy storage device 26 is thereby prevented. Simultaneously an indication is given, for example by means of an LED 100 on the spool, that the energy storage device 26 has been fully charged. Further steps in the deployment and blasting process can then take place.

The invention claimed is:

1. A detonator assembly (10) which includes a detonator (28), a holder (14) which comprises a spool (14), a flexible elongate element (40) which is coiled on the spool (14), an energy storage device (26) on the spool (14), a communication device (30B) which is mounted to the spool, a secondary inductive coil (32) which is mounted to the spool wherein the spool is movable relative to a magnetic field thereby to induce current into the coil which current is used to charge the energy storage device wherein initially the energy in the energy storage device is inadequate for firing the detonator and wherein movement of the coil through the magnetic field transfers adequate energy into the energy storage device to enable the detonator assembly to become operative and to fire the detonator.

2. A detonator assembly according to claim 1 wherein the energy storage device initially is charged with energy which is inadequate to fire the detonator but which is adequate for powering the communication device or, optionally, the energy storage device initially has no energy.

3. A detonator assembly according to claim 2 wherein the elongate element comprises a shock tube and electrically conductive wires which are included in the shock tube for communication purposes with the detonator.

4. A detonator assembly according to claim 1 wherein the flexible elongate element comprises a shock tube, a fibre optic cable, or one or more electrically conductive cables or wires.

5. A detonator assembly according to claim 1 wherein the spool is rotatably mounted to a support.

6. A detonator assembly according to claim 1 which includes a communication module which is mounted to the spool and which is configured to communicate with a blast controller, a relay station or another detonator assembly in a bidirectional manner.

* * * * *